US008499478B1

(12) United States Patent
Glass et al.

(10) Patent No.: US 8,499,478 B1
(45) Date of Patent: Aug. 6, 2013

(54) GIFT CARD PRESENTER

(75) Inventors: Brett R. Glass, Overland Park, KS (US); Nicole E. Glass, Overland Park, KS (US)

(73) Assignee: Gift Card Impressions, LLC, Kansas City, MO (US)

( * ) Notice: Subject to any disclaimer, the term of this patent is extended or adjusted under 35 U.S.C. 154(b) by 0 days.

(21) Appl. No.: 13/053,204

(22) Filed: Mar. 21, 2011

Related U.S. Application Data

(60) Provisional application No. 61/315,978, filed on Mar. 21, 2010.

(51) Int. Cl.
*G09F 1/00* (2006.01)

(52) U.S. Cl.
USPC ..... 40/124.14; 40/124.08; 446/148

(58) Field of Classification Search
USPC ..... 40/124.08, 124.14, 539; 248/459, 248/460; 229/92.8; 446/147–150
See application file for complete search history.

(56) References Cited

U.S. PATENT DOCUMENTS

| | | | | |
|---|---|---|---|---|
| 4,349,973 | A * | 9/1982 | Penick et al. | 40/124.08 |
| 5,884,770 | A | 3/1999 | Galm | |
| 6,418,648 | B1 | 7/2002 | Hollingsworth et al. | |
| 6,536,145 | B2 * | 3/2003 | Burtch et al. | 40/124.08 |
| 6,877,263 | B2 | 4/2005 | Clark | |
| 6,966,135 | B1 | 11/2005 | McDonald | |
| 7,584,558 | B2 | 9/2009 | Boyd et al. | |
| 2006/0101678 | A1 | 5/2006 | Wilen | |
| 2006/0151348 | A1 | 7/2006 | Willard | |
| 2010/0170822 | A1 | 7/2010 | Davis | |

FOREIGN PATENT DOCUMENTS

JP 19 2007-285593 A 5/2009

OTHER PUBLICATIONS

Jane Izumi Matsumoto, Pop up gift card holder tutorial, Whoopsie Daisy, Feb. 7, 2009, http://whoopsiedaisy-jane.blogspot.com/2009/02/pop-up-gift-card-holder-tutorial.html.

* cited by examiner

*Primary Examiner* — Joanne Silbermann
*Assistant Examiner* — Christopher E Veraa
(74) *Attorney, Agent, or Firm* — Polsinelli PC

(57) ABSTRACT

A card holder including a pop-up element for holding and presenting a card when the card holder is opened.

2 Claims, 10 Drawing Sheets

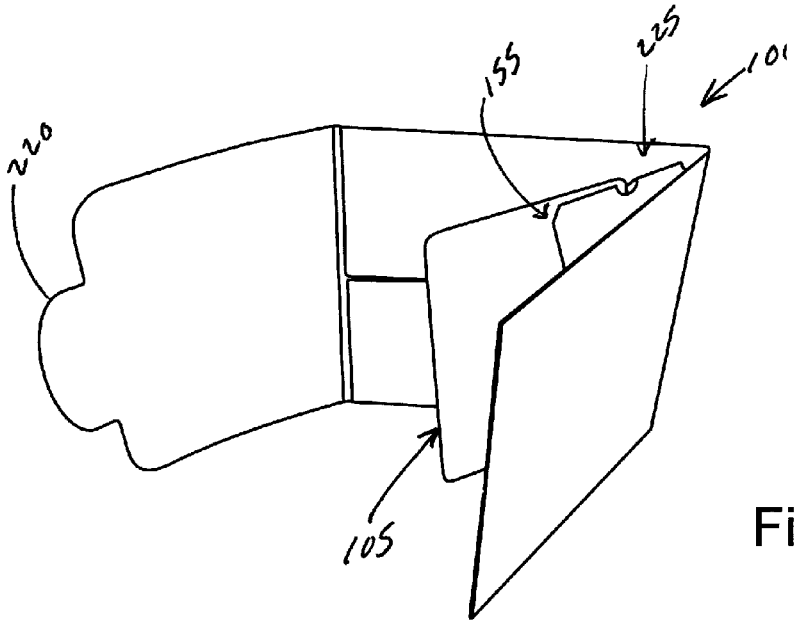
Fig. 7
Fig. 8
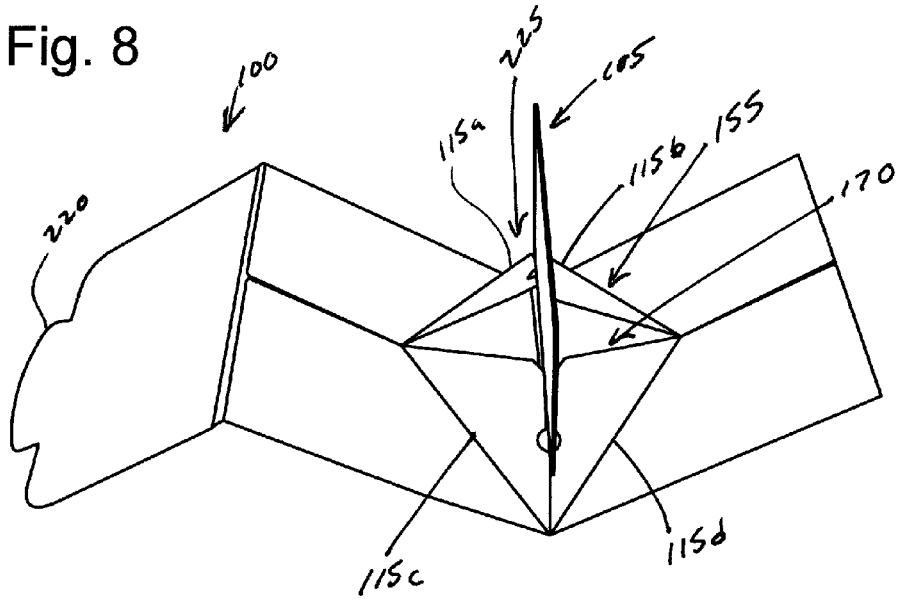

GIFT CARD PRESENTER

CROSS REFERENCE TO RELATED APPLICATION

This application claims the benefit of the prior filed, provisional application Ser. No. 61/315,978, filed Mar. 21, 2010.

BACKGROUND OF THE INVENTION

This invention relates generally to gift card holders and more particularly to a device for holding and presenting a gift card to entertain the recipient and enhance the value of the gift.

Transaction cards, stored value cards, or gift cards as they are commonly called based upon their intended use, have become popular gifts. Gift cards typically comprise a stored value card whereby a certain cash equivalent value is encoded upon a magnetic strip applied to the surface of the card. This stored value may be determined by the vendor prior to packaging and display for sale or, more commonly, is selected at the point of sale by the purchaser and loaded by the cashier using a magnetic card reader/writer. In other cases, a gift card may be provided with a barcode or serial number that is used to identify or link the card to a vendor or third party account that stores the value assigned to the card. In such cases, the bar code may be scanned by a bar code reader, or the account number may be entered into a vendor or third party computer system. While popular, gift cards are typically provided with a generic and impersonal design, typically identifying the associated merchant for which the card may be used to purchase merchandise, and therefore are not personalized in view of the intended recipient.

Gift card holders in the prior art that attempt to address some of the above deficiencies may contain pop-up elements to provide visual interest and serve as surfaces for bearing graphics but do create movement of the card itself in a way that conveys the presentation of the gift card to the gift recipient as an item of special significance or importance.

What is needed, therefore, is a device capable of readily holding a gift card while providing an entertaining and visually appealing presentation of the gift card to the recipient in a manner that enhances the perceived value of the gift card as a gift of special significance.

BRIEF DESCRIPTION OF THE INVENTION

The purpose of this invention is to provide a pop-up presenter for holding and presenting a gift card when the presenter is opened. The presenter includes a slot for holding the gift card within a pop-up structure that moves and stands off from the major surfaces of the presenter when the presenter is opened. In addition, the presenter may include one or more enhancement elements such as graphics and text upon the presenter surfaces.

An embodiment of a card holder may include a relatively planar main body having a longitudinal axis and a transverse axis. The main body is folded along a fold line substantially parallel to the transverse axis to divide the main body into a first major panel and a hingedly connected second major panel. The main body may therefore be opened and closed with the major panels serving as covers or flaps. A first presentation panel and an adjacent second presentation panel project upward from the first major panel. Similarly, a third presentation panel and an adjacent fourth presentation panel project upward from the second major panel. The first and third presentation panels are adjacent to each other across the fold line and the second and fourth presentation panels are adjacent to each other across the fold line.

The first and third presentation panels are divided or separated from each other, at least partially, by a slit sized to accommodate a portion of a card, such as a gift card or other financial transaction card. The second and fourth presentation panels are divided or separated from each other, at least partially, by a slit sized to accommodate a portion of the transaction card. The transaction card may therefore be inserted into and held between the first and third presentation panels and the between the second and fourth presentation panels. Upon opening the major panels the card is thereby presented in an upstanding disposition to a user.

Other advantages of the invention will become apparent from the following description taken in connection with the accompanying drawings, wherein is set forth by way of illustration and example an embodiment of the present invention.

BRIEF DESCRIPTION OF THE DRAWINGS

FIG. 7 is a perspective view of the presenter in a partially open position.

FIG. 8 is a view of the presenter in an open position showing the gift card held and vertically extended by the fingers.

DETAILED DESCRIPTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
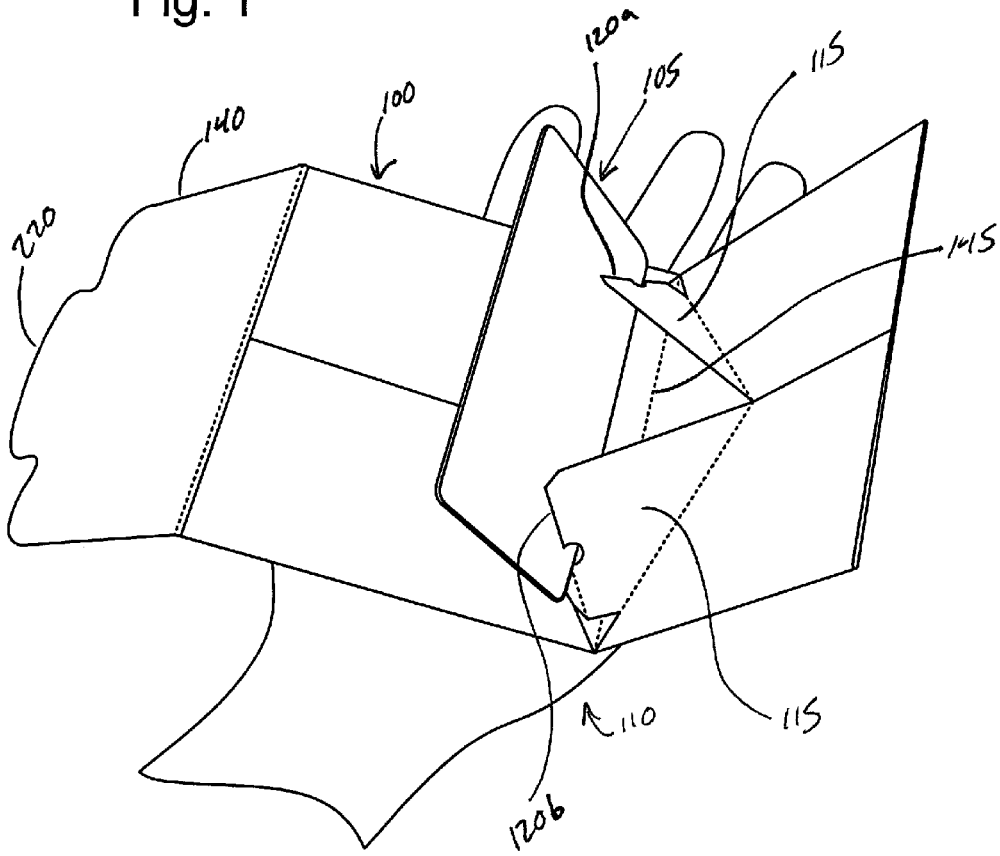
FIG. 1 is an illustration showing a gift card presenter with a gift card held in an upward presentation position after insertion of the card into the holder slot by the gift giver and opening of the holder by the gift recipient.

With reference to the figures, FIG. 1 is an illustration of a gift card presenter 100 showing a gift card 105 held in an upward presentation position as the presenter is held in the hand 110 of a gift card recipient. The presenter 100 includes four presentation panels or fingers 115 (two are shown in FIG. 1) that grip and hold the gift card 105 when inserted into the card slits 120*a* and 120*b*.

Figure 4:
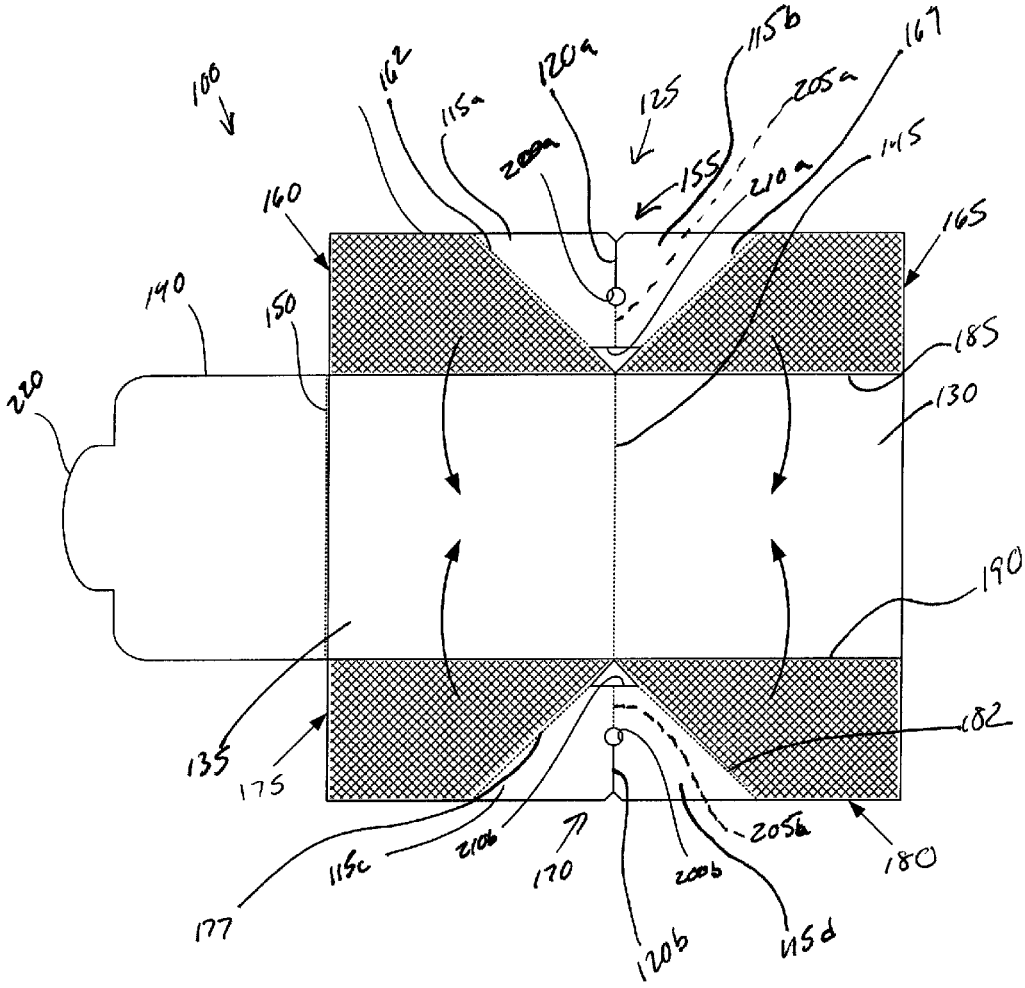
FIG. 4 is a top plan view of a gift card presenter showing the extending panels and extending panel bases in fully open positions prior to folding and assembly.

The gift card presenter 100 may be constructed completely or principally from a single sheet 125 of cardstock or similar material. FIG. 4 is a top plan view of a gift card presenter sheet 125 showing the flap, panel, and base elements in an open position prior to assembly. As shown in FIG. 4, the sheet 125 may be cut and folded to define two major panels, first major panel 130 and second major panel 135, and closure flap 140. The first major panel 130 is separated from the second major panel 135 by transverse fold line 145. The second major panel 135 is separated from the closure flap 140 by transverse fold line 150.

A first extending panel 155 projects from, and bridges across, extending panel bases 160 and 165. A second extending panel 170 projects from, and bridges across, extending panel bases 175 and 180. Extending panel bases 160 and 165 are separated from major panels 130 and 135 by longitudinal fold line 185. Extending panel bases 175 and 180 are separated from major panels 130 and 135 by longitudinal fold line 190.

First extending panel 155 is divided transversely by slit 120*a*, circular cut-out or aperture 200*a*, fold line 205*a*, and triangular cut-out or aperture 210*a*, which all cooperate to allow extending panel 155 to fold about a line coincident with fold line 205*a* and thereby extend away from major panels 130 and 135 when in such a folded disposition. These same elements operate to divide extending panel 155 into two presentation fingers 115*a* and 115*b*. Presentation finger 115*a* is separated from extending panel base 160 by oblique fold line 162. Presentation finger 115*b* is separated from extending panel base 165 by oblique fold line 167. The angle between fold line 162 and fold line 185, and between fold line 167 and fold line 185, is approximately 45 degrees.

Figure 2:
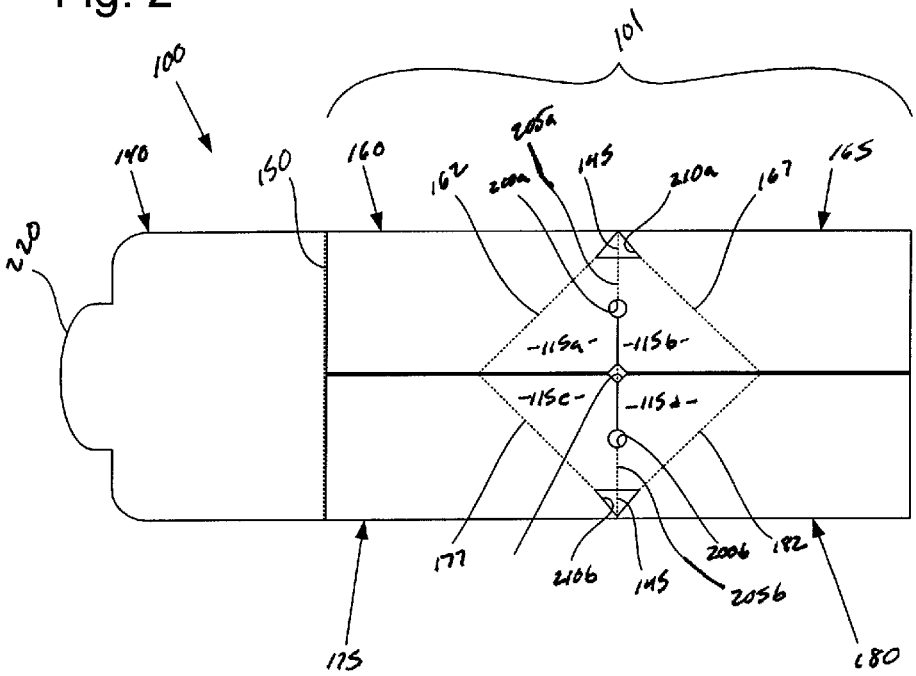
FIG. 2 is a top plan view of a gift card presenter in a fully open disposition and with all elements, including pop-up elements, panels and flaps, laying flat in a substantially common plane.
Figure 3:
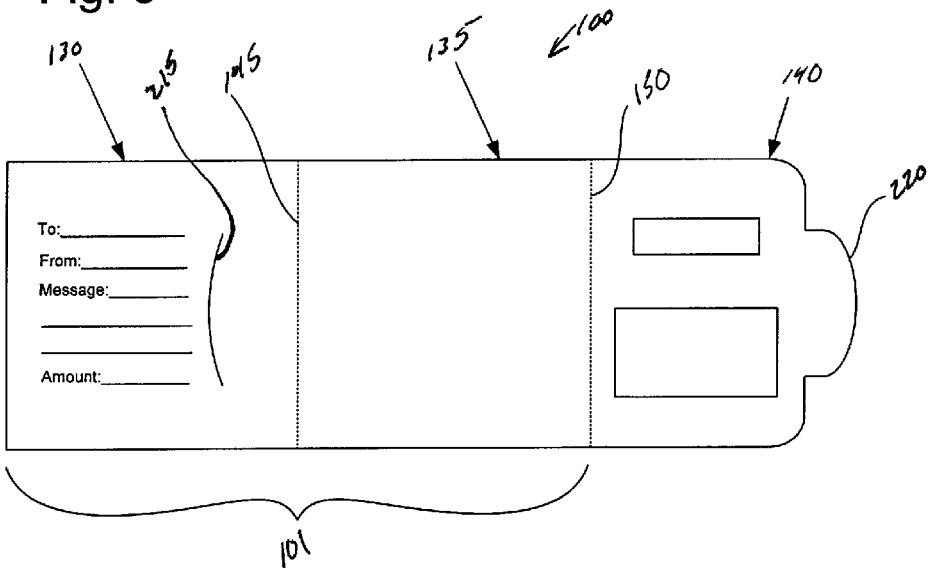
FIG. 3 is a bottom plan view of the gift card presenter shown in FIG. 2.

In a similar fashion, second extending panel 170 is divided transversely by slit 120*b*, circular cut-out or aperture 200*b*, fold line 205*b*, and triangular cut-out or aperture 210*b*, which all cooperate to allow extending panel 170 to fold about a line coincident with fold line 205*b* and thereby extend away from major panels 130 and 135 when in such a folded disposition. These same elements operate to divide extending panel 170 into two presentation fingers 115*c* and 115*d*. Presentation finger 115*c* is separated from extending panel base 175 by oblique fold line 177. Presentation finger 115*d* is separated from extending panel base 180 by oblique fold line 182. The angle between fold line 177 and fold line 190, and between fold line 182 and fold line 190, is approximately 45 degrees. The major panels 130 and 135, extending panel bases 160, 165, 175, and 180, and extending panels 155 and 170 combine to form a primary presenter structure 101, indicated in FIGS. 2 and 3 by a bracket, such elements being generally necessary for the primary functioning of this embodiment of a presenter 100 as a structure for holding and presenting a gift card 105 in an uplifted disposition spaced apart from the major surface planes of the presenter 100. FIGS. 2 and 3 show the presenter 100 as assembled, with the extending panel bases glued or otherwise adhered in position upon the major panels. FIG. 2 is a top plan view of a gift card presenter 100 completely unfolded and as it would appear after the extending panel bases shown in FIG. 4 have been folded and attached to the major panel bases. FIG. 3 is a bottom plan view of the gift card presenter 100 of FIG. 2 after rotating the presenter 100 around an axis parallel to either of fold lines 145 or 150.

Triangular apertures 210 are provided each of the two five-panel junctures of fingers 115, bases 160, 165, 175, and 180, and major panels 130 and 140, to reduce paper material at the juncture that would otherwise restrict movement of the fingers 115 and other elements when the presenter 100 is opened and closed. In addition, by thereby removing a portion of each extending panel 155 and 170 the force exerted by the fingers 115 against the sides of the gift card 105 is increased since the triangular apertures 210 allow the distal (typically upward) portions of the fingers 115 to be pressed together more tightly as the presenter 100 is opened and the fingers 115 rotate inwardly around fold lines 162, 167, 177, and 182. The removal of material at the triangular apertures 210 reduces overall thickness of the panel layers at the apertures 210 and reduces binding that would otherwise tend to occur at the juncture. Without the triangular apertures 210, the forces applied to the gift card 105 would not be moved upward to a higher leverage point on the card 105 and the fingers 115 would be anchored or braced at the juncture, which would tend to reduce the force applied at the distal portions of the fingers 115.

The card slits 120*a* and 120*b* formed by opposing sides of fingers 115*a* and 115*b*, and 115*c* and 115*d*, respectively, comprise the primary means for holding a gift card 105 within the presenter 100 in that the fingers 115 engage the sides of the gift card 105 when the gift card 105 is placed within the slots 120. Circular apertures 200*a* and 200*b* provide a secondary means for holding the gift card 105 in that the edges (which may be referred to as the lower edges in light of the typical presenter disposition) of each aperture 200 that oppose the intersection of the aperture 200 with a slit 120 abut and support the adjacent (lower) edge of the gift card 105. Because the gift card 105 rests upon and is supported upon the lower edges of the apertures 200, the finger edges that define the slits 120 may move across the planar surfaces of the gift card 105 when the presenter 100 opens and the fingers 115 extend, thereby providing lateral support to the gift card 105 while not restricting movement of the gift card 105 along the aperture edges as the presenter 100 is opened.

Figure 5:
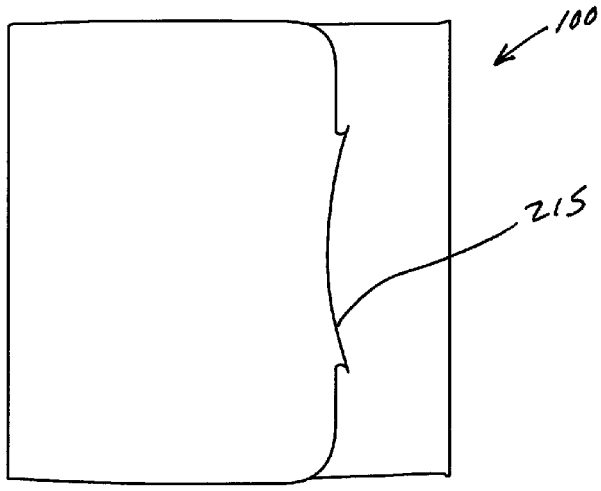
FIG. 5 is a top plan view of the presenter in a folded, closed position.
Figure 6:
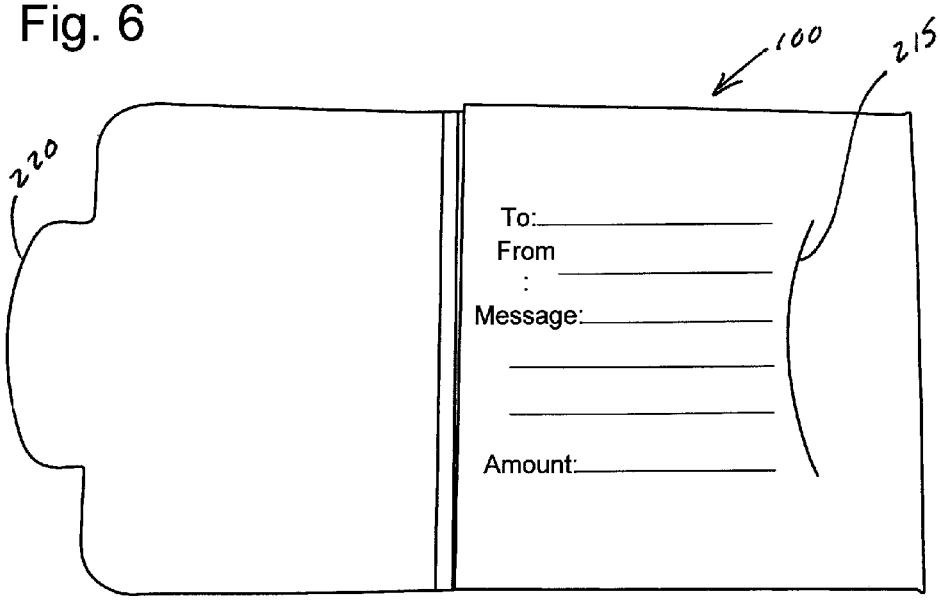
FIG. 6 is a top plan view of the presenter with the main panels folded upon one another but the closure flap open.

Turning to FIGS. 3, 5 and 6, the outer surface of major panel 130 may include a means for fastening the flap 140 to the major panel 130 such as a slot 215 sized to accept a tab 220 projecting outward from the flap 140. It should be appreciated that other closure mechanisms may be employed such as hook and loop fasteners or removable adhesive. FIG. 5 is a top plan view of the presenter 100 in a folded, closed position, showing the tab 220 inserted into the slot 215. FIG. 6 is a top plan view of the presenter 100 with the main panels of the primary presenter structure 101 folded upon one another but the closure flap 140 in an open position. This view, along with the illustration in FIG. 3, shows presenter indicia printed on the surface of the presenter 100 including to/from lines (for indicating the names of the gift giver and gift recipient), lines for the gift giver to write a message, and a line for indicating the monetary amount loaded onto the enclosed gift card 105. A presenter 100 may or may not include such indicia.

In use, the gift card 105 is inserted into the card slots 120*a* and 120*b* by the gift giver who then folds the presenter as shown in FIG. 6 and then as shown in FIG. 5. The circular apertures 200 accept the leading (typically lower) edge of the gift card 105 as it is inserted into the slots 120. The gift card 105 is pushed into the slits 120 and between the fingers 120 until the leading edge of the card 105 is stopped by or abuts the lower edge of each aperture 200. The primary presenter structure 101 is folded by folding major panel 130 inwardly and upon major panel 135. Flap 140 is then folded upon major panel 130 and, in this embodiment, tab 220 is inserted into slot 215 so that the presenter appears substantially as shown in FIG. 5. When the gift recipient receives and opens the gift card presenter 100, the sequence is substantially reversed. The tab 220 is removed from the slot 215 and the flap 140 and primary presenter structure 101 are unfolded. As the primary presenter structure 101 is unfolded, the fingers 115 pivot in an inwardly directed arc around fold lines 162, 167, 177 to grip one end of the gift card 105 between fingers 115*a* and 115*b* and the other end of the gift card 105 between fingers 115*c* and 115*c* and to hold and present the gift card 105 in an upward, generally vertical position.

FIG. 7 provides a perspective view of a presenter 100 in a partially open position in which the gift card 105 may seen held within the pop-up structure 225 of the presenter 100, which principally comprises the extending panels 155 and 170 and sub-elements. Since the primary presenter structure 101 is mostly folded, the pop-up structure 225 is also mostly in a folded position.

Figure 9:
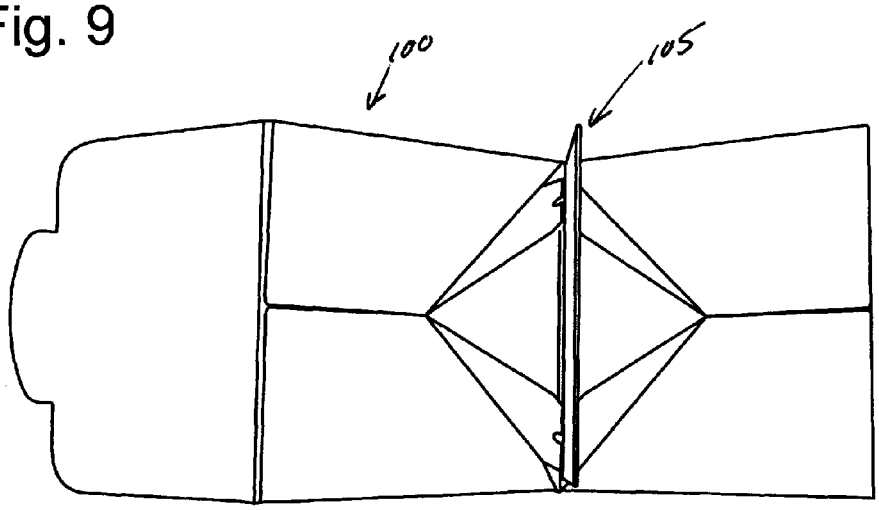
FIG. 9 is a top view of the presenter in an open position showing the gift card held and vertically extended by the fingers.
Figure 10:
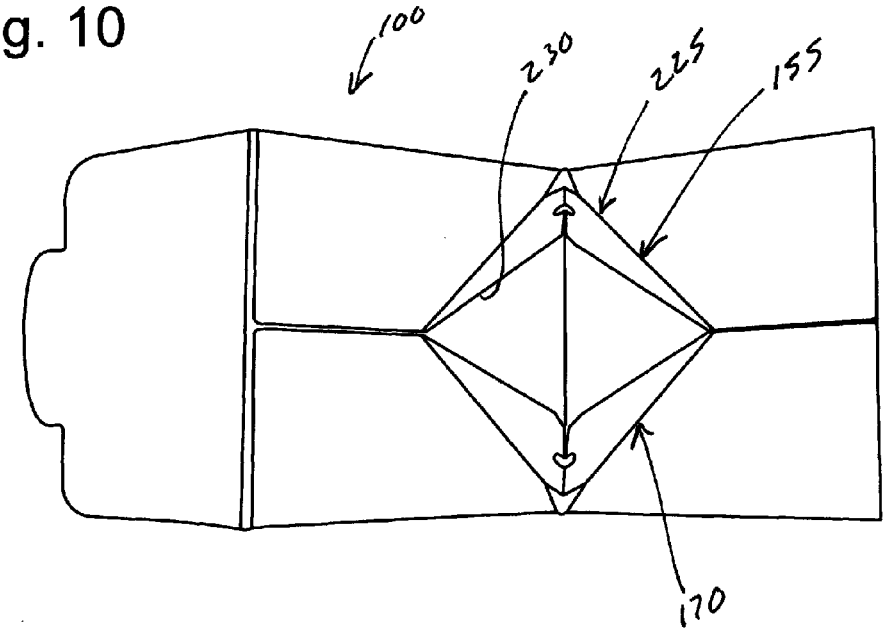
FIG. 10 is a top view of the presenter similar to FIG. 9 but with the gift card removed from the fingers.
Figure 11:
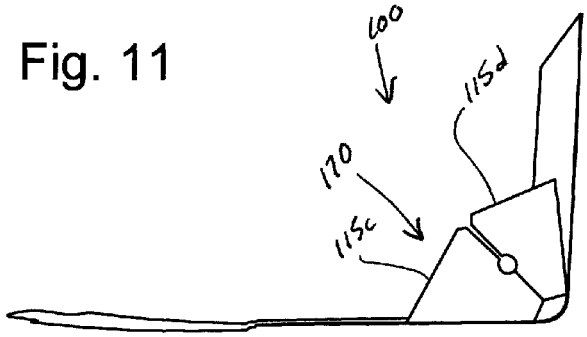
FIG. 11 is a side view of the presenter showing an extending panel and fingers.
Figure 12:
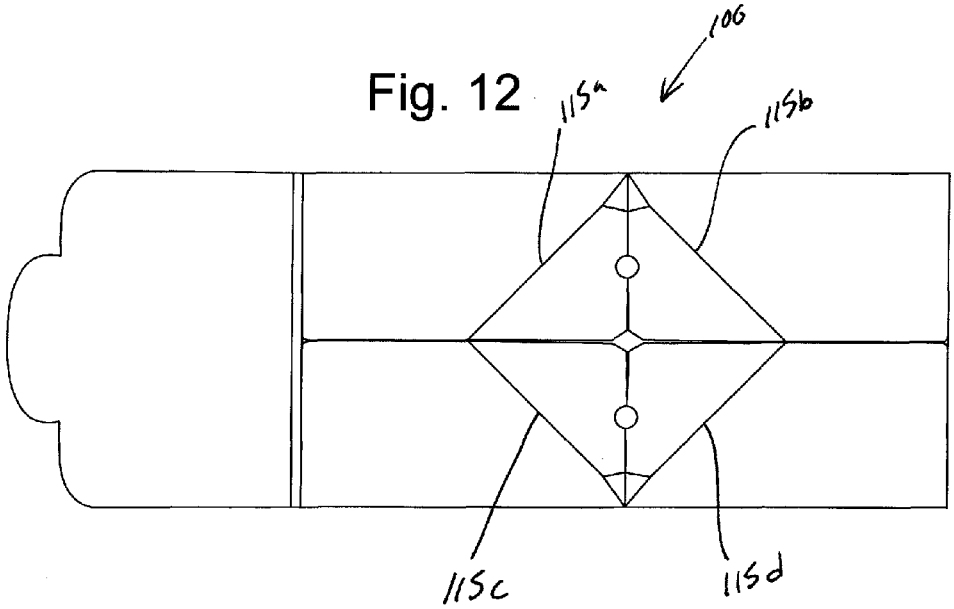
FIG. 12 is a top plan view of the presenter showing the fingers folded downward and flay against the major panels.

FIG. 8 is an angled view of the presenter 100 in an open position showing the gift card 105 held and vertically extended above the major panels 130 and 135 by the fingers 115 of the pop-up structure 225. FIG. 9 is a top view of the open presenter 100 shown in FIG. 8. FIG. 10 is also a top view of the presenter 100 but with the gift card 105 removed from the pop-up structure 225 to more clearly show the open space 230 between the extending panels 155 and 170 when the pop-up structure 225 is in an extended position. FIG. 11 is a side view of a partially open presenter 100 showing extending panel 170 and fingers 115*c* and 115*d*. FIG. 12 is a top plan view of the presenter 100 showing the fingers 115 folded downward against the main panels 130 and 135.

A presenter may be configured to hold a gift card 105 as shown in FIGS. 1, 7, 8 and 9 with a single leading long edge of the card 105 held within the slits 120 and abutting the apertures 200, or with a leading short edge passed between the extending panels so that both long edges are held within the slits, i.e. with the card 105 rotated 90 degrees within the plane of the card from the disposition shown in FIGS. 1, 7, 8 and 9.

Figure 13:
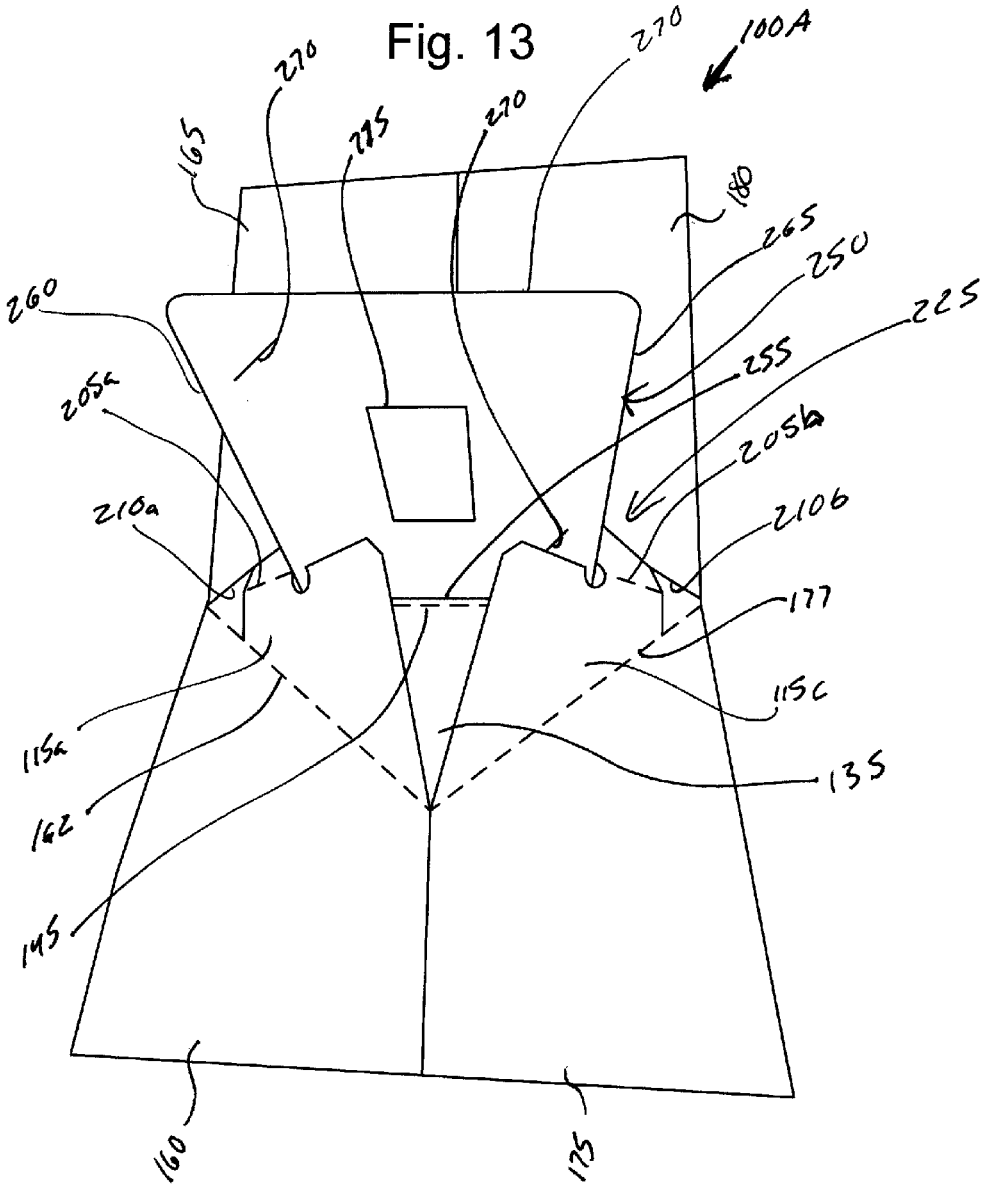
FIG. 13 is a left perspective view of an alternative embodiment of a presenter having a gift card stabilizing insert.

FIG. 13 is a left perspective view of an alternative embodiment of a presenter 100A. The flap 140 has been omitted for clarity. The presenter 100A includes an insert 250 attached within the open space 230 of a pop-up structure 225 to a major panel 130 or 135 (130 as configured and shown in FIG. 13). The insert 250 is attached at its lower edge 255 to a portion of the major panel 130 proximate to, and in parallel alignment with, the fold line 145. The insert 250 is generally rectangular and planar in shape with long side edges 260 and 265 extending generally perpendicularly from the attached major panel 130. A top edge 220 is furthest disposed from the major panel 130, when the pop-up structure 225 is extended. The insert 250 functions to support or hold a gift card 105 within the presenter 100A. The insert 250 may include means for attaching or securing the gift card 105 thereon such as slits 270, typically formed near diagonally opposing corners of the insert 250, or removable adhesive 275 applied to the surface of the insert 250 to abut the card 105.

Figure 14:
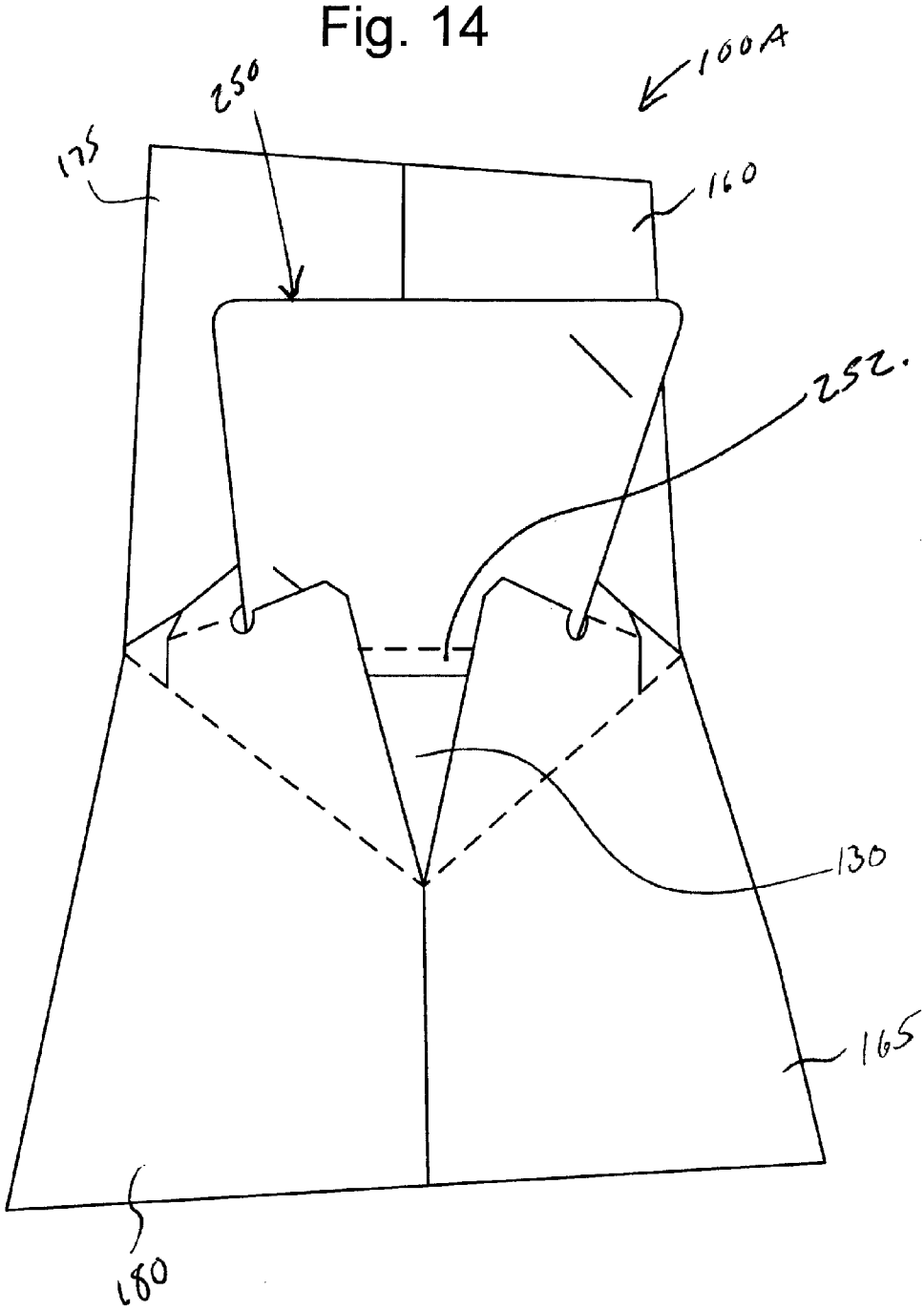
FIG. 14 is a right perspective view of the presenter of FIG. 13 showing the insert attached to a major panel via an insert tab.

FIG. 14 is a right perspective view of the presenter 100A of FIG. 13 showing the insert 250 attached to major panel 130 via an insert tab 252 that projects from the lower edge 255 of the insert 250 and may be bent to rest at an approximately 90° angle relative to the body of the insert 250. The lower portion of the tab 252 may be adhered to the main panel 130 using adhesive or other means.

Figure 15:
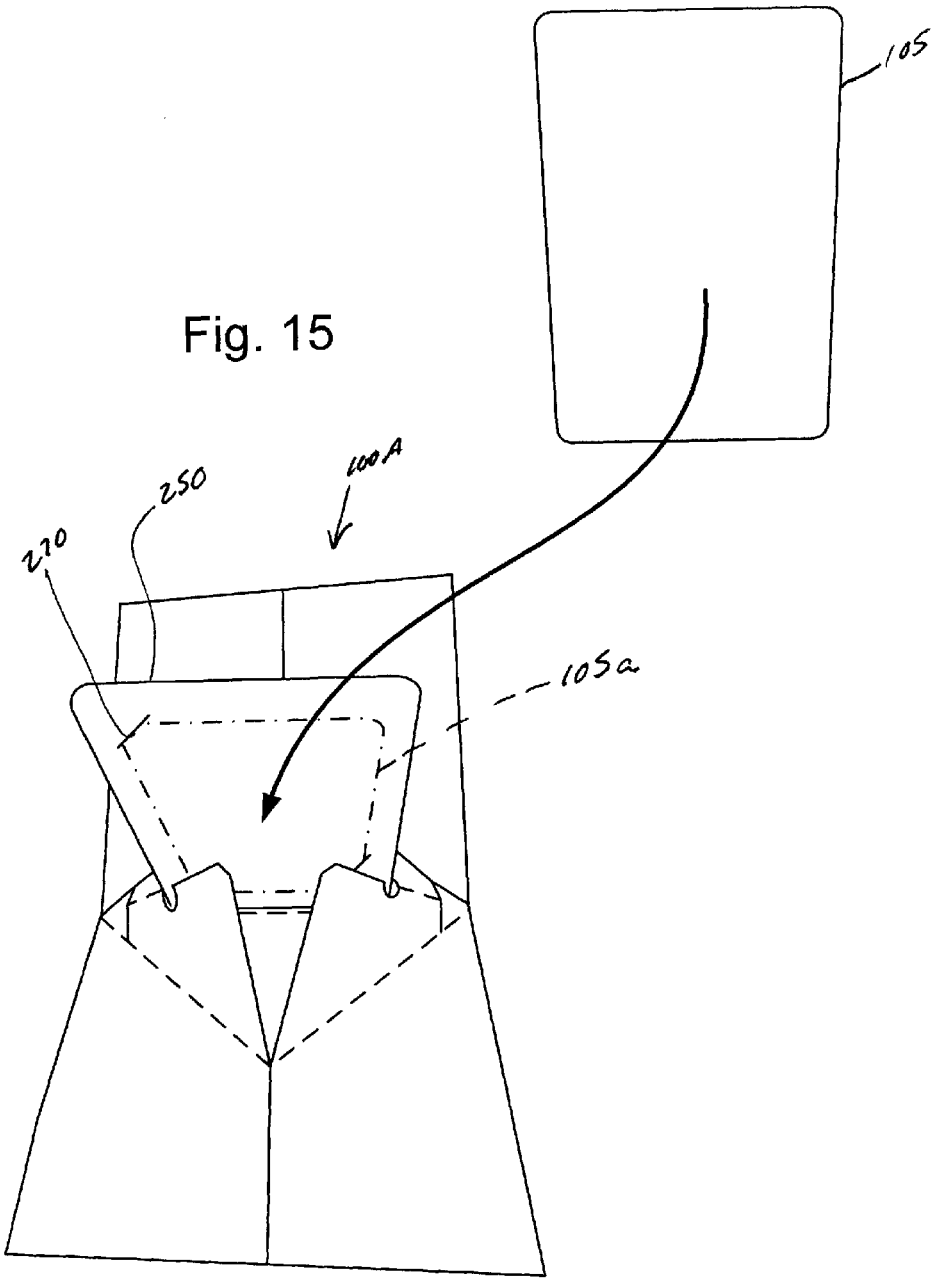
FIG. 15 is a partially exploded, left perspective view of a presenter positioned to receive a gift card.

FIG. 15 is a partially exploded, left perspective view of a presenter 100A positioned to receive a gift card 105 upon the insert 250. The location and disposition of the gift card 105, once attached to the insert slits 270, is shown via phantom line 105*a*.

Having thus described the invention, what is claimed as new and desired to be secured by Letters Patent is:

1. A card holder comprising:

a relatively planar main body having a longitudinal axis and a transverse axis, said main body folded along a fold line substantially parallel to said transverse axis, said fold line dividing said main body into a first major panel and a hingedly connected second major panel, a first presentation panel projecting upward from said first major panel, a second presentation panel projecting upward from said first major panel, a third presentation panel projecting upward from said second major panel, a fourth presentation panel projecting upward from said second major panel, a first slit between said first presentation panel and said third presentation panel, a second slit between said second presentation panel and said fourth presentation panel, said slits sized to receive and hold a card therein.

2. A card presenter comprising:

a first major panel and a second major panel, said major panels attached to one another along a transverse fold line, a first extending panel attached across said transverse fold line to said major panels, said first extending panel divided by a first slit to form a first set of presentation fingers, and a second extending panel attached across said transverse fold line to said major panels, said second extending panel divided by a second slit to form a second set of presentation fingers, said slits sized to receive a card within, and between opposing sides of said presentation fingers, and to hold said card spaced apart from the major surface planes of the presenter.

* * * * *